United States Patent [19]

Fischer et al.

[11] Patent Number: 4,750,614

[45] Date of Patent: Jun. 14, 1988

[54] CONTAINER ESPECIALLY FOR FOODS

[75] Inventors: Richard Fischer, Offenburg-Bürgel, Fed. Rep. of Germany; Horst W. Ackermann, Orbe, Switzerland

[73] Assignee: Nestec S.A., Vevey, Switzerland

[21] Appl. No.: 936,909

[22] Filed: Dec. 2, 1986

[30] Foreign Application Priority Data

Dec. 3, 1985 [DE] Fed. Rep. of Germany ..... 8533908

[51] Int. Cl.[4] ..... B65D 51/16; B65D 51/00

[52] U.S. Cl. ..... 206/45.31; 220/366; 220/377

[58] Field of Search ..... 220/306, 366, 377; 206/45.31, 45.32, 45.33, 45.34, 551

[56] References Cited

U.S. PATENT DOCUMENTS 3,797,730 3/1974 Zach ..... 220/306 X
4,206,845 6/1980 Christian ..... 220/366 X

FOREIGN PATENT DOCUMENTS 1761384 9/1971 Fed. Rep. of Germany .
169528 8/1934 Switzerland ..... 220/377

*Primary Examiner*—William Price
*Attorney, Agent, or Firm*—Vogt & O'Donnell

[57] ABSTRACT

This disclosure describes a plastic container with a bottom portion, having a base, a lower stand-on-edge and an upper rim, and with a cover portion having a peripheral vertical wall which engages the upper rim of the base. Parts designed to engage lockingly with one another are present on the portions in the form of projections and in the form of indentations at regular intervals about the circumference of the portions. Guide surfaces are positioned about one of the portions and extend towards the locking elements of the other portion for guiding the locking elements of the portions to converge for engagement.

14 Claims, 2 Drawing Sheets

CONTAINER ESPECIALLY FOR FOODS

BACKGROUND OF THE INVENTION

This invention relates to a container especially for foods.

A two-piece box is known from DE-PS No. 1 761 384 which comprises a base of a plastics material and a cardboard cover consisting of a disc and a wall. In the closed position, the wall of the cover engages over a wall of the base. The co-operation of the elasticity of the plastics material of the base with the stretchability of the cardboard material used for the cover is said adequately to guarantee safe closing of the box compared with boxes where both the base and the cover or a side ring of the cover are made of plastic. With boxes of this type, the parts have to be made with considerable precision or adapted very closely to one another in their diameters to ensure sufficiently safe closure. However, this is virtually impossible to achieve in practice.

In addition, it has been said that boxes consisting entirely of plastic for packing cheese would have the disadvantage of now allowing the cheese to breathe.

In the known box, closure is made safer by the fact that an inner bead on the lower edge of the cover wall engages in a groove in the outer wall of the base.

SUMMARY OF THE INVENTION

The present invention seeks to provide an easy-to-handle container in which both the cover and the base are made of plastic, which can be closed easily and safely without extraordinary precision requirements having to be satisfied during the production process. The container is also intended to be able to be made without difficulty in such a way that its interior is ventilated, should this be desirable or necessary for a product to be accommodated therein. This invention also seeks to provide an advantageous construction of the container even in its details. Further problems associated with all this which the invention seeks to solve will become apparent from the description of the particular solution provided.

According to the invention, the cover portion is made in one piece of a plastics material. Individual interengaging locking elements in the form of projections and indentations are provided on the rim of the bottom portion and on the peripheral wall, or zone, of the cover portion at regular intervals over their circumference and guide surfaces extending towards the locking elements of one of the portions are situated on that portion for the locking elements of the other portion.

The invention thus provides a container which may be manufactured without difficulty either by deep drawing or by injection moulding and which, in addition to easy handling, guarantees a firm connection between the bottom portion and the cover portion in the closed position. The guide surfaces ensure that, when the cover portion is put on, the individual locking elements brought into engagement are moved towards one another and into satisfactory engagement.

The locking elements are advantageously formed as deformations or the like in the wall of the particular portion. They may have a round or rectangular basic shape. However, other configurations are also possible.

The guide surfaces are best associated in pairs with a locking element and are shaped in such a way that they converge thereon. Irrespective of the angular position in which the cover is put on and moved downwards, the locking elements also engage safely in one another.

The container may be designed in such a way that its interior is at least substantially sealed off hermetically from the outside. On the other hand, it is also possible in accordance with the invention, apart from all the other advantages, to allow an exchange of air between the inside and outside, as is desirable for certain products, without any risk of the contents leaking. To this end, air passages are provided in, particular between, the bottom portion and the cover portion placed thereon.

In addition, the cover portion may be designed to meet various requirements.

Further details, features and advantages of the invention will become apparent from the following description of embodiments, the associated drawings.

DESCRIPTION OF PREFERRED EMBODIMENTS

Figure 1:
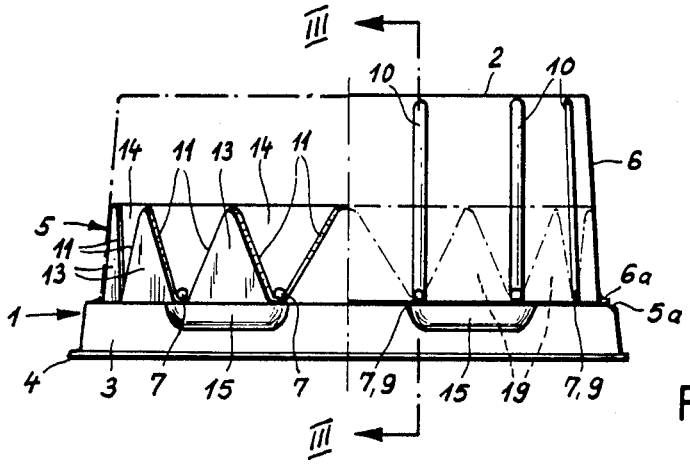
FIG. 1 is an elevation of one embodiment of the container, on the right-hand side with the cover portion and on the left-hand side with the cover portion in dash-dot lines.

The container shown in FIGS. 1 to 4 comprises a bottom portion 1 and a cover portion 2. Both portions are made of a plastics material, more especially by deep drawing or by injection moulding. The plastics material may be non-transparent, opaque or clear. A particularly practical embodiment is one comprising a non-transparent, namely white, bottom portion and a transparent or translucent cover portion through which the contents can be seen. The container is advantageously circular in shape.

The bottom portion 1 comprises a lower wall 3 with a lower stand-on edge 4, a base 21 and a rim globally denoted by the reference 5. The rim 5 is slightly set back radially inwards in relation to the lower wall 3 and forms a step **5*a* and is covered by a peripheral wall, hereinafter, zone 6 of the cover portion 2** in the closed position of the container.

Individual locking elements in the form of indentations 7 directed radially inwards, are present in the rim 5 at regular intervals over its circumference. These indentations 7 have a substantially round basic shape and are formed during production of the bottom portion as deformations in the wall 8 thereof. Projections 9, directed radially inwards on the peripheral zone 6 of the cover portion 2, are designed to engage lockingly in these indentations 7, as shown in particular in FIG. 3. When the cover portion 2 is placed on the bottom portion 1, the wall 8 of the rim 5 and even the cover portion are able to yield or give way elastically until this locked state, and hence the closed position of the container, is reached.

Figure 3:
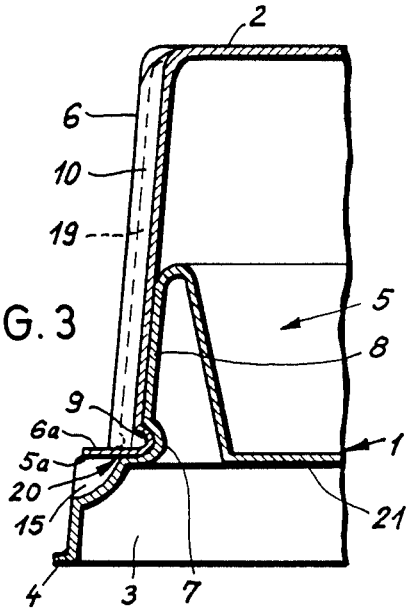
FIG. 3 is a section on the line III—III in FIG. 1.
Figure 7:
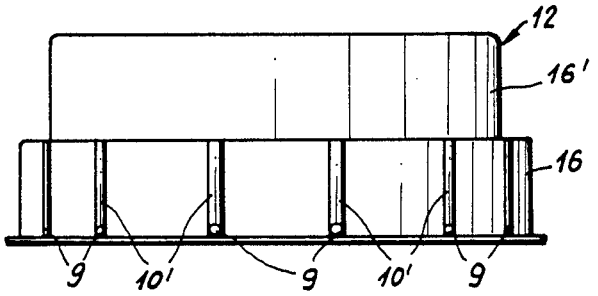
FIG. 7 is an elevation of another embodiment of the cover portion.

In the embodiment illustrated, the cover portion 2 is internally provided in its peripheral zone 6 with ribs 10 which extend in the direction of generatrices and which may be formed as thickened parts of the wall or, with particular advantage, as formed parts of the wall. As shown in the drawing, these ribs are located with particular advantage at those places where the locking elements, i.e., in this case the projections 9, are situated. As shown in FIGS. 1 and 3, the ribs 10 may extend over the entire height of the peripheral zone 6 of the cover portion 2 or, alternatively, only over a part of that height, more especially over a height substantially corresponding to the rim 5 of the bottom portion 1. This is shown in FIG. 7 where the ribs of the cover portion 12 are denoted by the reference 10'. Irrespective of this, FIG. 7 shows one of several other possible forms of the cover portion. The cover portion 12 has a stepped form in that particular case so that a peripheral portion 16, which fits onto the rim 5 of the bottom portion 1, and, above this peripheral portion, a cap-like portion 16' of smaller diameter are present.

Figure 2:
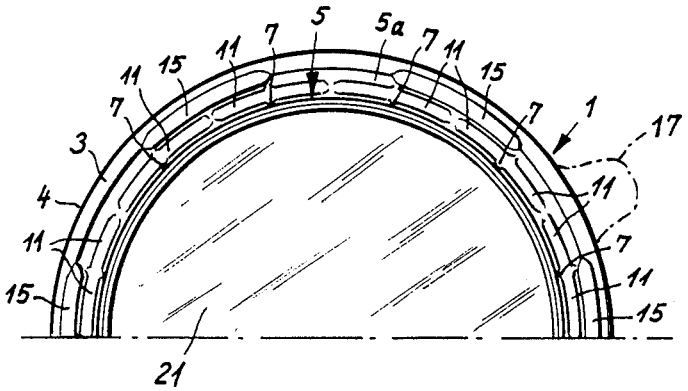
FIG. 2 is a partial plan view of the bottom portion.
Figure 4:
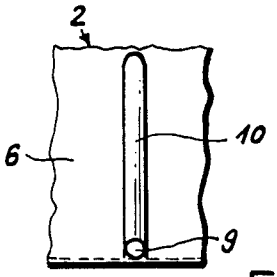
FIG. 4 shows part of the cover portion from inside.

In the embodiment shown in FIGS. 1 to 3, guide surfaces 11 for the projections 9 of the cover portion 2 acting as locking elements are provided on the rim 5 of the bottom portion 1. In the advantageous embodiment illustrated, these guide surfaces 11 converge downwards in pairs on an indentation 7 acting as a locking element. This results in the formation of substantially triangular zones 13 and 14 of which the latter are recessed and situated radially further inwards than the zones 13, the transitions forming the guide surfaces 11. The zones 13 situated further outwards have rounded-off upper tips.

When the cover portion 2 is placed on the bottom portion 1, the projections 9 are always guided to the indentations 7 by the guide surfaces 11, irrespective of the angular position of the cover portion. This enables the container to be closed easily without any problems whatever because the cover portion is always guided into its correct position.

In the embodiment illustrated, the insides of the ribs 10 in the closed position of the container lie on the outside of the wall 8 of the rim 5 in the zones 14, as shown in FIG. 3. In addition to the locking effect of the locking elements 7,9, this guarantees satisfactory seating of the cover portion 2 on the bottom portion 1. Those parts of the peripheral zone 6 of the cover portion 2 which lie between the ribs 10 may rest fully with their insides on the outer surfaces of the raised triangular zones 13 of the rim 5. Because, at the same time, a lower rim **6*a* of the peripheral zone 6 bears on the step 5*a* between the wall 3 and the rim 5 of the bottom portion 1, optionally under a bias or pressure generated in the interlocking state of the elements 7,9** through suitable dimensioning, the container may be hermetically sealed where necessary.

On the other hand, the interior of the container may also be ventilated with advantage. A favourable possibility in this regard is to leave a small intermediate space 19 at least locally between the outer surfaces of the raised or elevated zones 13 of the rim 5 and the associated parts of the peripheral zone 6 of the cover portion 2. This small intermediate space 19 thus communicates with the interior of the container. At the same time, an airway also leads to it from outside. This may be achieved in various ways, for example, by apertures or openings in the peripheral zone 6 of the cover portion or in the lower rim **6*a* thereof. In the advantageous embodiment illustrated, the lower wall 3 of the bottom portion 1 is formed with recesses 15 of such shape and size that they establish an air link at the point 20 with the intermediate space 19** and hence with the interior of the container.

It is also possible to provide air passages in the vicinity of the locking elements 7,9, optionally, even in conjunction with recesses 15 of corresponding length and arrangement.

Irrespective of their function as airways, the recesses 15 may also serve as a finger space for opening the container. The bottom portion 1 may also be provided with a grip tab 17 or the like, as shown in dash-dot lines in FIG. 2.

Figure 5:
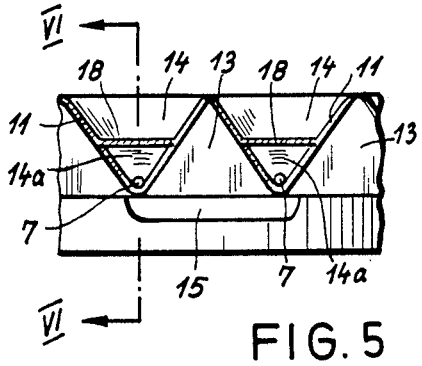
FIG. 5 is a partial elevation of a modified embodiment of the bottom portion.
Figure 6:
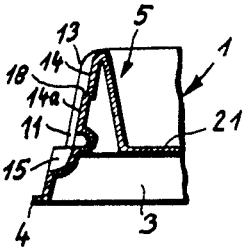
FIG. 6 is a section on the line VI—VI in FIG. 5.

FIGS. 5 and 6 show a modified embodiment. This embodiment differs from that shown in FIGS. 1 to 3 in that a step 18 is provided in the depressed zones 14, forming a lower region **14*a* which projects radially further outwards corresponding to that shown in FIG. 3**, for example, in regard to the position of the outside of its wall. A construction with a step such as this may be of advantage in various respects, inter alia, for additionally increasing stability.

Figure 8:
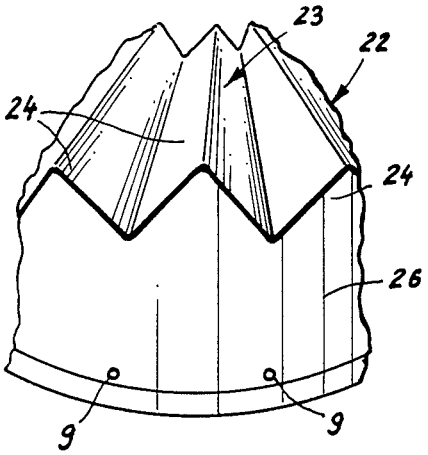
FIG. 8 shows part of another embodiment of the cover portion.

FIG. 8 is a partial elevation of a cover portion 22 which is provided in its head region with a profiling 23 of which the individual profile elements 24 are roof-like in cross-section and, from the middle, widen radially outwards where they terminate in a cylindrical peripheral zone 26. The division of the profiling, i.e., the repetition of the individual profile elements 24, corresponds to the division of the locking elements 7, 9. A construction such as this is not only attractive in appearance, but it may also be used to accommodate an article having a profiled surface, for example a confectionery item or an ice dessert or the like, without any risk of damage when the cover portion is put on. The profiling may of course assume a different form from that shown in FIG. 8 according to requirements.

In the described embodiments of the container, projection 9 on the cover portion and indentations 7 on the bottom portion are provided as locking elements. However, this arrangement may also be reversed so that the projections are provided on the bottom portion and corresponding indentations in the cover portion to receive the projections.

All features mentioned in the foregoing description and illustrated in the accompanying drawings are intended, where permitted by the prior art, to be regarded individually and in combination as falling within the scope of the invention.

We claim:

1. A plastic container comprising a plastic cover portion having a peripheral vertical wall which engages an upper rim portion of a plastic bottom portion having a base, a lower stand-on edge and the upper rim, by a plurality of locking elements selected from the group consisting of projections and indentations and combinations thereof at regularly spaced intervals about the circumference of each of the peripheral wall and the upper rim, such that when the container is closed, the projections and indentations are lockingly engaged, and one of the peripheral wall and upper rim having guide surfaces regularly spaced about its circumference which upon closing the container, converge the locking elements of the peripheral wall and upper rim for locking engagement.

2. A container as claimed in claim 1 which further comprises the cover having a plurality of ribs extending vertically from the peripheral wall.

3. A container as claimed in claim 2 wherein the ribs are positioned at the position of the locking elements of the peripheral wall.

4. A container as claimed in claim 3 wherein the peripheral wall contains all of the projections and the upper rim contains all of the indentations.

5. A container as claimed in claim 1 or 2 or 3 wherein the guide surfaces are associated in pairs to converge the projections into the indentations.

6. A container as claimed in claim 5 wherein the pairs of guide surfaces are formed by transitions between alternately recessed and elevated rim zones and form substantially triangular zones to converge the projections into the indentations.

7. A container as claimed in claim 1 wherein all of the projections are provided on the peripheral wall and all of the indentations are provided on the upper rim.

8. A container as claimed in claim 7 which further comprises the cover having a plurality of ribs extending vertically from the peripheral wall.

9. A container as claimed in claim 8 wherein the ribs are positioned at the position of the locking elements of the peripheral wall.

10. A container as claimed in claim 7 or 8 or 9 wherein the guide surfaces are associated in pairs to converge the projections into the indentations.

11. A container as claimed in claim 10 wherein the pairs of guide surfaces are formed by transitions between alternately recessed and elevated rim zones and form substantially triangular zones to converge the projections into the indentations.

12. A container as claimed in claim 10 wherein at least one step is provided in the recessed rim zone.

13. A container as claimed in claim 1 or 2 or 9 further comprising air passages between the peripheral wall and the upper rim.

14. A container as claimed in claim 13 wherein the air passages are provided in the vicinity of the locking elements and are at least partly formed by intermediate spaces between the upper rim and the peripheral wall.

* * * * *

UNITED STATES PATENT AND TRADEMARK OFFICE

CERTIFICATE OF CORRECTION

PATENT NO. : 4,750,614

DATED : June 14, 1988

INVENTOR(S) : Richard FISCHER, et al.

It is certified that error appears in the above-identified patent and that said Letters Patent is hereby corrected as shown below:

Column 1, line 24, "now" should be --not--.
Column 1, line 37, after "a", insert --food--.
Column 1, line 38, "This" should be --The--.
Column 1, line 50, insert a comma after "circumference".
Column 2, line 10, delete the comma after "in" and the comma after "between"; insert a comma after "provided" and insert a comma after "particular".
Column 2, in the heading "DESCRIPTION OF PREFERRED EMBODIMENTS", insert --DETAILED-- before "DESCRIPTION".
Column 2, line 54, "in" should be --on--.
Column 2, line 54, after "7", insert a comma.
Column 4, line 20, "inter alia" should be italicized and underscored.
Column 6, line 14, (patent claim 13, line 1), "2" should be --3--.

Signed and Sealed this

Tenth Day of January, 1989

*Attest:*

*Attesting Officer*

DONALD J. QUIGG

*Commissioner of Patents and Trademarks*